US011163246B2

(12) United States Patent
Ohhira et al.

(10) Patent No.: US 11,163,246 B2
(45) Date of Patent: Nov. 2, 2021

(54) DEVELOPING DEVICE INCLUDING A CONVEYOR WITH A SPACE BETWEEN BLADES AND IMAGE FORMING APPARATUS INCLUDING SAME

(71) Applicants: Tatsuya Ohhira, Kanagawa (JP); Koichi Yamazaki, Kanagawa (JP); Yuki Oshikawa, Kanagawa (JP); Takahiro Adachi, Kanagawa (JP)

(72) Inventors: Tatsuya Ohhira, Kanagawa (JP); Koichi Yamazaki, Kanagawa (JP); Yuki Oshikawa, Kanagawa (JP); Takahiro Adachi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/016,389

(22) Filed: Sep. 10, 2020

(65) Prior Publication Data

US 2021/0088938 A1 Mar. 25, 2021

(30) Foreign Application Priority Data

Sep. 25, 2019 (JP) ..... JP2019-174620

(51) Int. Cl.
*G03G 15/08* (2006.01)

(52) U.S. Cl.
CPC ..... *G03G 15/0893* (2013.01); *G03G 15/0889* (2013.01); *G03G 2215/0822* (2013.01)

(58) Field of Classification Search
USPC ..... 399/254
See application file for complete search history.

(56) References Cited

U.S. PATENT DOCUMENTS

2007/0231014 A1 10/2007 Noguchi et al.
2009/0169265 A1 7/2009 Yoshida et al.
(Continued)

FOREIGN PATENT DOCUMENTS

JP 2006-178381 7/2006
JP 2012-208422 10/2012
(Continued)

OTHER PUBLICATIONS

Extended European Search Report dated Feb. 9, 2021 in European Patent Application No. 20197732.9, 8 pages.

*Primary Examiner* — Q Grainger
(74) *Attorney, Agent, or Firm* — Xsensus LLP

(57) ABSTRACT

A developing device includes a developer bearer and a stirring conveyor. The stirring conveyor includes a first conveying chamber including a conveying member and a second conveying chamber to receive the developer from an end of the first conveying chamber. The conveying member includes a forward winding blade, a reverse winding blade, and a shaft portion on which the forward winding blade and the reverse winding blade are mounted with a space therebetween. A circumferential phase of the conveying member at a start position of the reverse winding blade is different from a circumferential phase of the conveying member at an end position of the forward winding blade. The conveying member is disposed in the first conveying chamber so that the space is opposite a portion at which the second conveying chamber receives the developer from the end of the first conveying chamber.

5 Claims, 6 Drawing Sheets

(56) References Cited

U.S. PATENT DOCUMENTS

| | | | | |
|---|---|---|---|---|
| 2013/0149009 | A1* | 6/2013 | Iwata | G03G 15/087 399/254 |
| 2017/0293257 | A1 | 10/2017 | Ohhira et al. | |
| 2018/0143568 | A1 | 5/2018 | Ohhira et al. | |
| 2018/0321617 | A1 | 11/2018 | Ota | |
| 2019/0265612 | A1* | 8/2019 | Ishida | G03G 15/0858 |
| 2020/0103824 | A1 | 4/2020 | Oshikawa et al. | |
| 2020/0117119 | A1 | 4/2020 | Mase et al. | |
| 2020/0174400 | A1 | 4/2020 | Kawashima et al. | |
| 2020/0264538 | A1 | 8/2020 | Ohhira et al. | |

FOREIGN PATENT DOCUMENTS

| | | |
|---|---|---|
| JP | 2014-145916 | 8/2014 |
| JP | 2018-091973 A | 6/2018 |

* cited by examiner

DEVELOPING DEVICE INCLUDING A CONVEYOR WITH A SPACE BETWEEN BLADES AND IMAGE FORMING APPARATUS INCLUDING SAME

CROSS-REFERENCE TO RELATED APPLICATION

This patent application is based on and claims priority pursuant to 35 U.S.C. § 119(a) to Japanese Patent Application No. 2019-174620, filed on Sep. 25, 2019, in the Japan Patent Office, the entire disclosure of which is incorporated by reference herein.

BACKGROUND

Technical Field

Aspects of the present disclosure relate to a developing device and an image forming apparatus including the developing device.

Related Art

Generally, there is known a developing device that includes a developer bearer and a stirring conveyor to convey a developer supplied to the developer bearer while stirring a developer.

SUMMARY

In an aspect of the present disclosure, there is provided a developing device that includes a developer bearer and a stirring conveyor configured to convey and stir a developer to be supplied to the developer bearer. The stirring conveyor includes a first conveying chamber including a conveying member and a second conveying chamber configured to receive the developer from an end of the first conveying chamber. The conveying member includes a forward winding blade configured to convey the developer in a first direction toward the end of the first conveying chamber, a reverse winding blade configured to convey the developer in a second direction opposite the first direction, and a shaft portion on which the forward winding blade and the reverse winding blade are mounted with a space between the forward winding blade and the reverse winding blade. A circumferential phase of the conveying member at a start position of the reverse winding blade is different from a circumferential phase of the conveying member at an end position of the forward winding blade. The conveying member is disposed in the first conveying chamber so that the space is opposite a portion at which the second conveying chamber receives the developer from the end of the first conveying chamber.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1A:
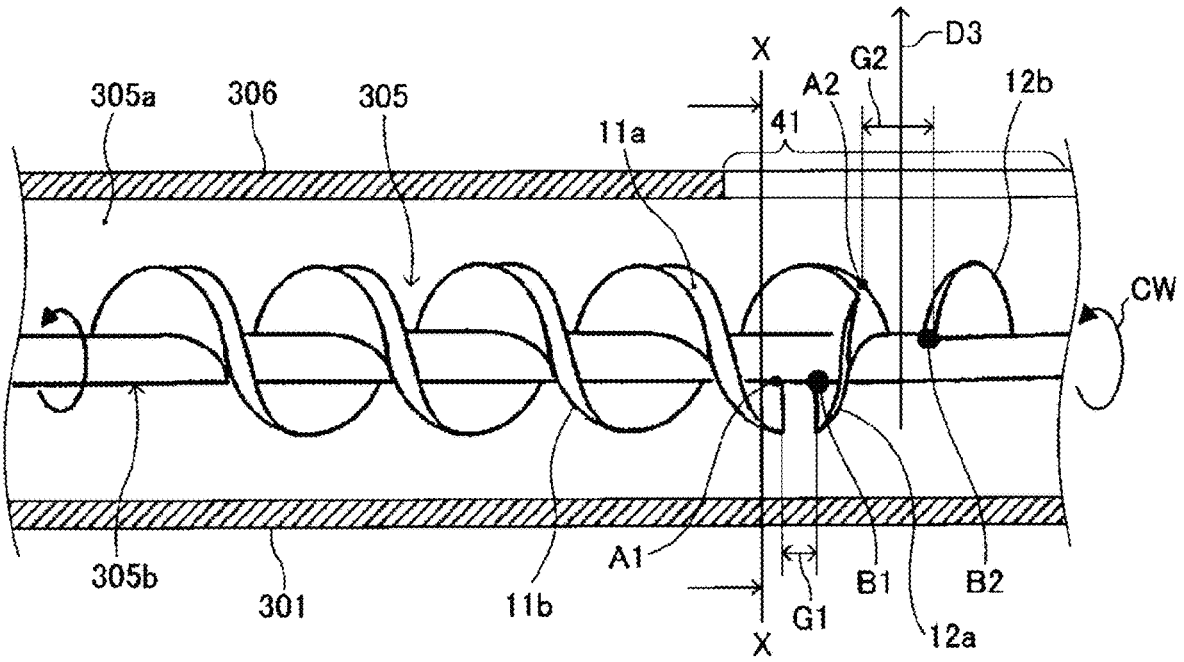
FIGS. 1A and 1B are partial enlarged views of a developing device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
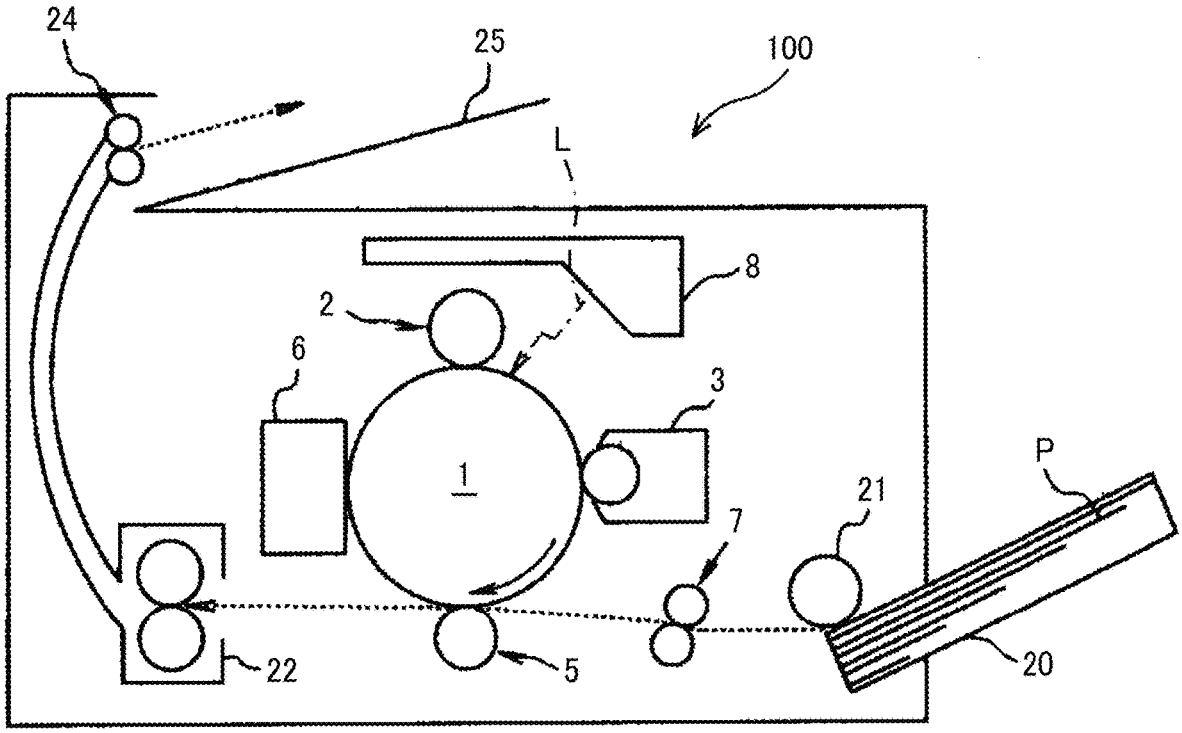
FIG. 2 is a schematic view of a printer.

Below, a description is given of a developing device of an electrophotographic printer as an image forming apparatus according to an embodiment of the present disclosure. FIG. 2 is a schematic view of a printer 100 as an image forming apparatus according to the present embodiment. A photoconductive drum 1 is uniformly charged by a charging device 2, and a writing device 8 irradiates the photoconductive drum 1 with exposure light L such as laser light based on image data to form an electrostatic latent image. The electrostatic latent image is developed by a developing device 3 to form a toner image. The toner image is transferred by a transfer device 5 onto a recording sheet P fed from a sheet tray 20 by a feed roller 21 and conveyed by a registration roller pair 7. The recording sheet P, on which the toner image has been transferred, is fixed by a fixing device 22 and discharged on a discharge tray 25 by a discharge roller 24. After the transfer, a cleaning device 6 removes residual toner and the like from a surface of the photoconductive drum 1 to prepare for the next image forming process.

Figure 3:
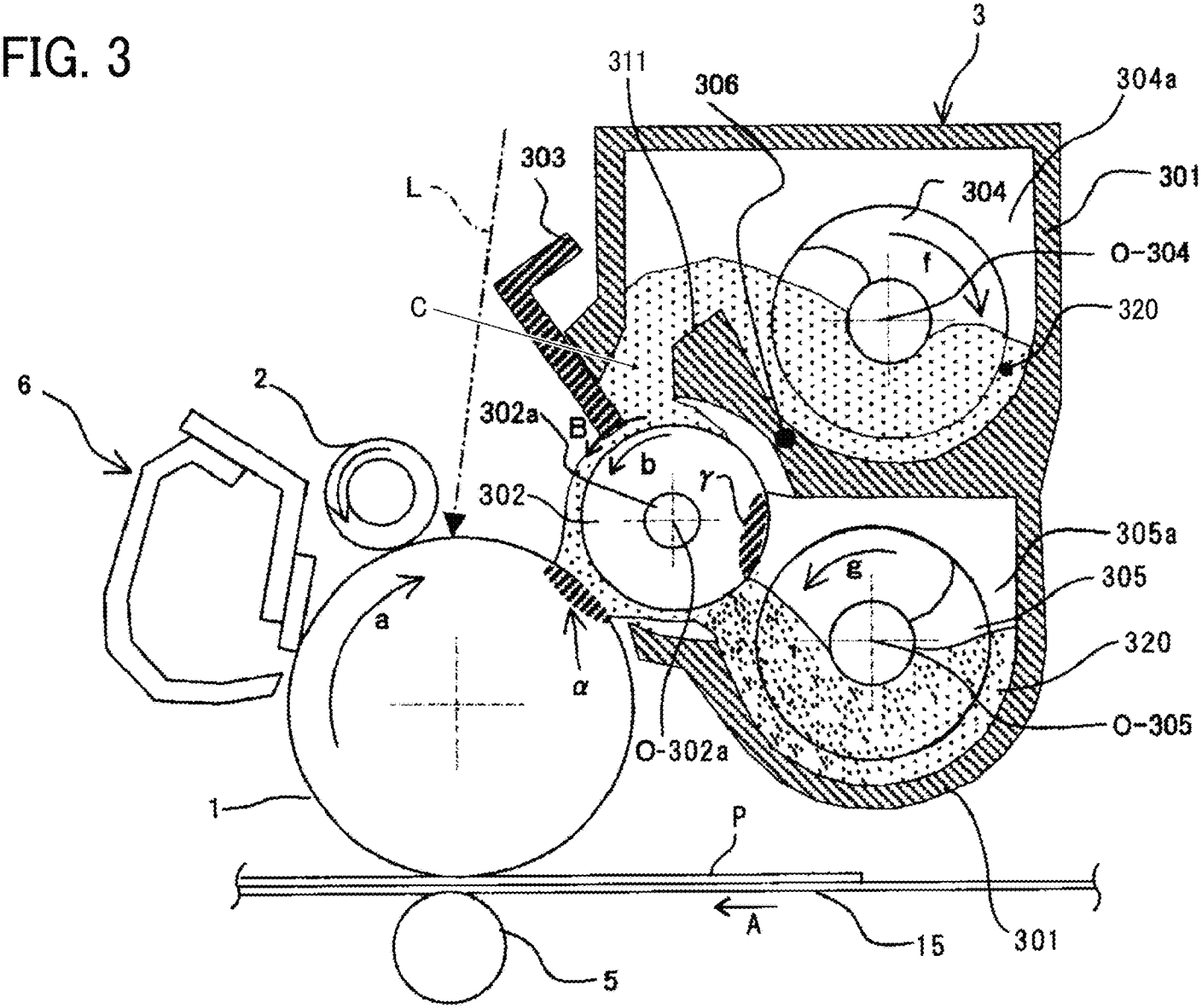
FIG. 3 is a schematic view of a configuration example of the developing device.

FIG. 3 is a schematic view illustrating the developing device according to an embodiment of the present disclosure. The developing device 3 according to the present embodiment is disposed on the right side of the photoconductive drum 1. The developing device 3 includes a supply-chamber conveying member 304 as a developer supply conveying member to stir and convey developer 320, a collection-chamber conveying member 305 as a developer collection conveying member, a rotating member such as a developing roller 302 as a developer bearer, and other members in a developer case 301.

The developing roller 302 forms a developing area α is disposed close to and opposite the photoconductive drum 1, which rotates in the direction indicated by arrow a, at a position between 2 o'clock and 3 o'clock (the position of half past two) of the photoconductive drum 1 in FIG. 3. A portion of the developer case 301 corresponding to a portion opposite the photoconductive drum 1 is open to expose the developing roller 302.

As the developing roller 302 rotates in the direction indicated by arrow b in FIG. 3, the developer 320 in the developer case 301 is borne on the surface of the developing roller 302 and is conveyed in the direction indicated by arrow b in FIG. 3. After the amount of additional developer 320 is regulated by a developer regulator 303, the developer 320 is conveyed to the developing area α. Toner in the developer 320 adheres to the electrostatic latent image formed on the surface of the photoconductive drum 1 in the developing area α, and the electrostatic latent image is developed as a visible toner image.

The developer 320 is stirred, conveyed, and circulated between the supply-chamber conveying member 304 and the collection-chamber conveying member 305. A screw member having spiral-shaped screw blade fixed to a rotating shaft portion is used as each of the supply-chamber conveying member 304 and the collection-chamber conveying member 305.

After toner is adhered to the electrostatic latent image on the photoconductive drum 1 to develop the electrostatic latent image as the toner image, the developer 320 has a decreased toner density. For this reason, if the developer 320 whose toner density has decreased is conveyed again to the developing area α without being separated from the developing roller 302 and is developed at the developing area α, a failure that a target image density cannot be obtained may occur. In order to prevent this failure, in the developing device 3, the developer 320 passed through the developing area α and borne on the surface of the developing roller 302 is released from the developing roller 302 in a releasing area γ. The developer 320 released from the developing roller 302 is collected in a collection chamber 305*a* as a developer collection conveying tube, and then sufficiently stirred and mixed in the developer case 301 so as to have a target toner density and a target toner charge amount.

The developer 320, which has been set to the target toner density and the target charge amount in such a way, is supplied to the developer storage space c by a supply-chamber conveying member 304 from a supply chamber 304*a* as a developer supply tube. In order to prevent the developer 320 from being directly pushed into a developer storage space c by the supply-chamber conveying member 304 disposed above the developing roller 302, the developer 320 is supplied to the developer storage space c so that the developer 320 is supplied to the developer storage space cover an inflow prevention wall 311. The inflow prevention wall 311 is formed in a portion of a partition plate 306 described below.

Figure 4:
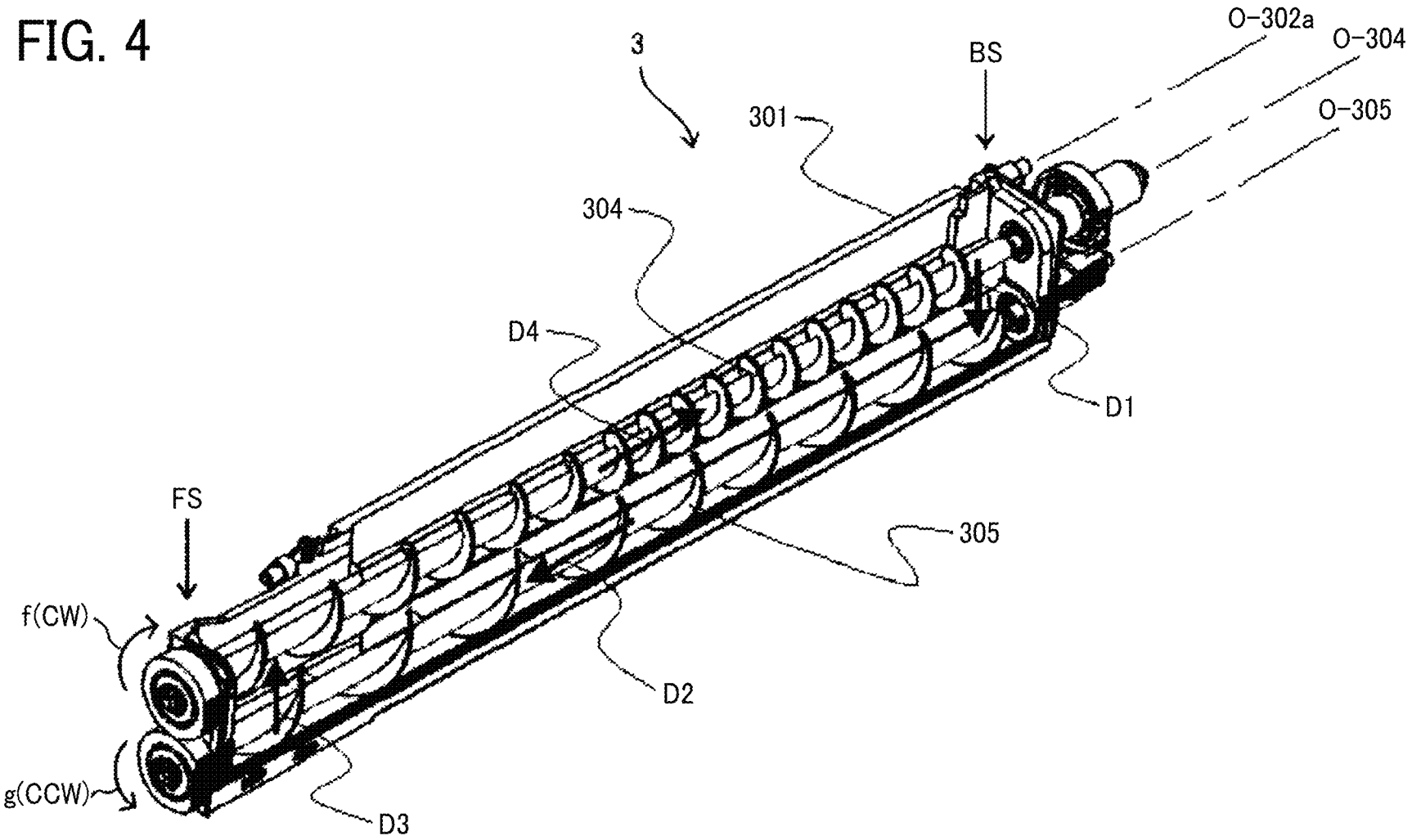
FIG. 4 is a perspective view illustrating an internal structure of a main part of the developing device.
Figure 5:
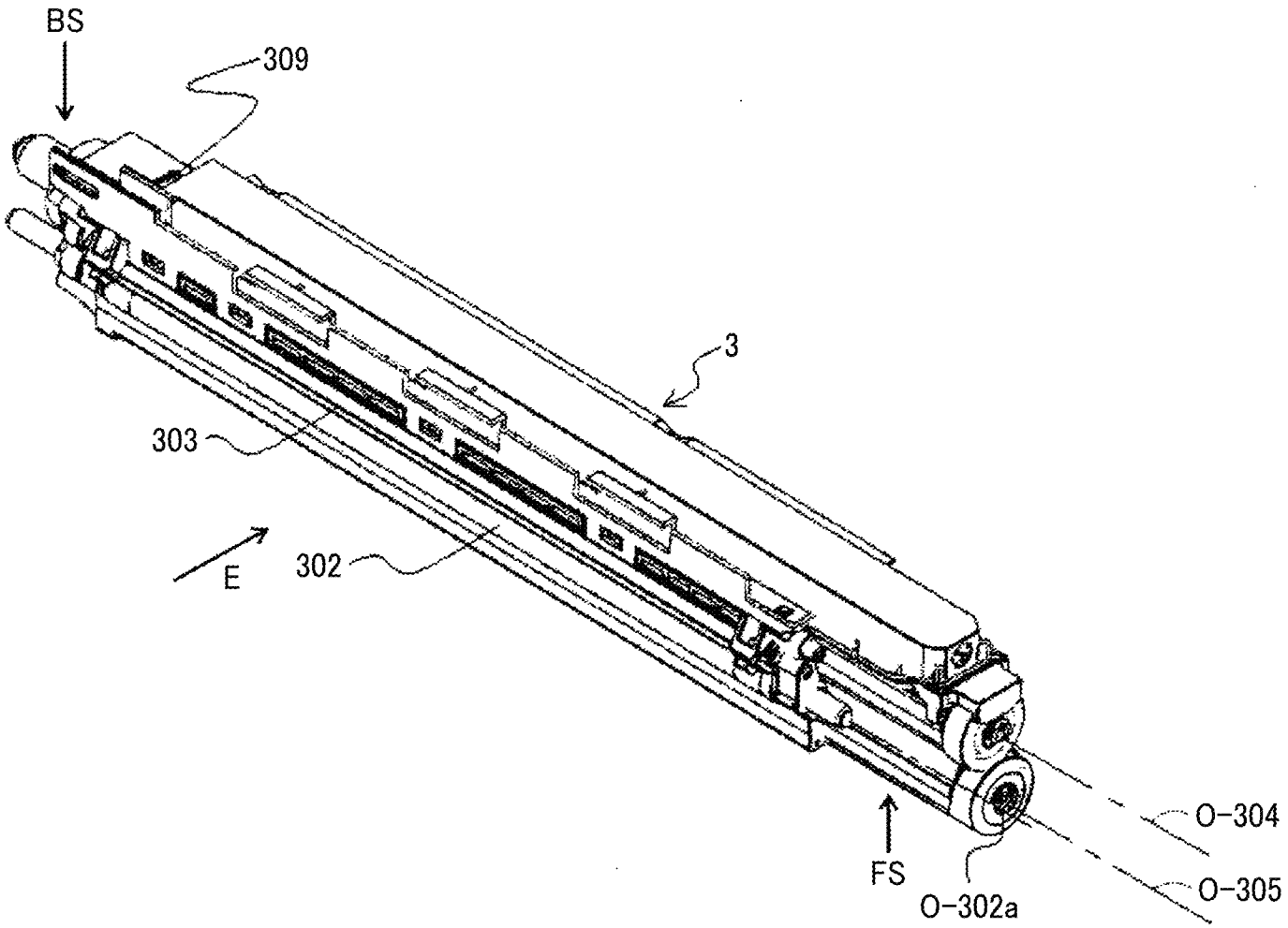
FIG. 5 is a perspective view of an appearance of the main part of the developing device.
Figure 6:
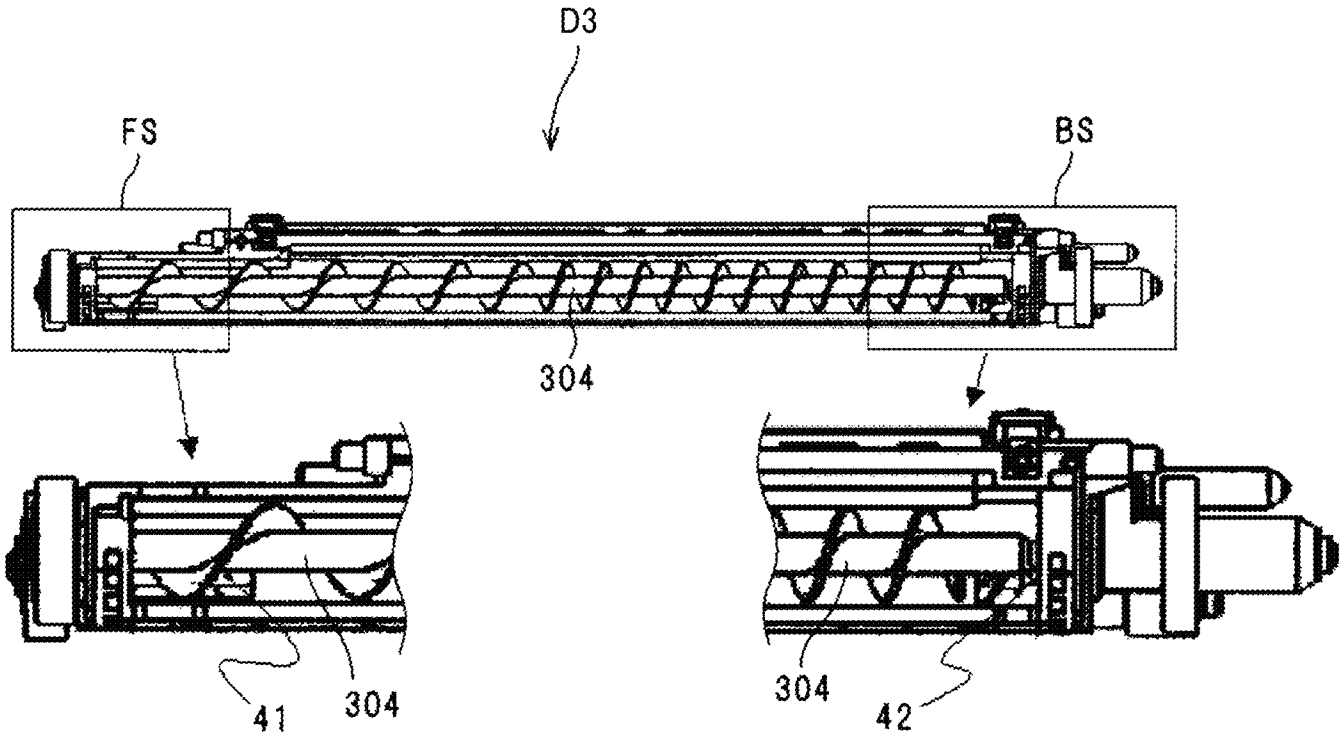
FIG. 6 is a schematic view of the developing device seen from above.

FIG. 4 is a perspective view illustrating an internal structure of a main part of the developing device 3, and FIG. 5 is a perspective view of the main part of the developing device 3. FIG. 6 is an explanatory view illustrating a portion of the developing device 3 in which communication ports 41 and 42 are provided on the partition plate 306 at both ends of the developing device 3 in the longitudinal direction of the developing device 3. Arrows D1 to D4 of FIG. 4 illustrate flows of the developer 320 in the developer case 301.

As illustrated in FIG. 3, the supply-chamber conveying member 304 is disposed at a position around the developing roller 302 and in the direction of two o'clock of the developing roller 302 in FIG. 3. This position is also on an upstream side in the direction of rotation of the developing roller 302 with respect to an opposite portion of the developing roller 302 disposed opposite the developer regulator 303. As illustrated in FIG. 4, the supply-chamber conveying member 304 has a screw shape with spiral blade portion around the rotating shaft. The supply-chamber conveying member 304 rotates in the clockwise direction indicated by arrow f in FIG. 3 around a supply screw centerline O-304 of the supply-chamber conveying member 304, which is parallel to a developing roller centerline O-302*a* of the developing roller 302. With this rotation, as illustrated by the arrow D4 in FIG. 4, the developer 320 is stirred and conveyed from the front side FS toward the rear side BS in the longitudinal direction of the developing device 3 along the supply screw centerline O-304. In other words, as a rotary drive is input to the rotating shaft, the supply-chamber conveying member 304 conveys the developer 320 from the front side FS toward the rear side BS in the axial direction.

As illustrated in FIG. 3, the collection-chamber conveying member 305 is disposed at a position around the developing roller 302 and near the releasing area γ in the direction of four o'clock of the developing roller 302 in FIG. 3. As illustrated in FIG. 4, the collection-chamber conveying member 305 has a screw shape with spiral blade (fin) around the rotating shaft, and rotates in the counterclockwise direction indicated by arrow g in FIG. 3 around a collecting screw centerline O-305 of the collection-chamber conveying member 305, which is parallel to the developing roller centerline O-302*a* of the developing roller 302. With this rotation, as illustrated by the arrow D2 in FIG. 4, the developer 320 is stirred and conveyed from the rear side BS toward the front side FS in the longitudinal direction of the developing device 3 along the collecting screw centerline O-305. In other words, as a rotary drive is input to the rotating shaft, the collection-chamber conveying member 305 conveys the developer 320 from the rear side BS toward the front side FS in the direction opposite to the conveying direction by the supply-chamber conveying member 304.

The supply-chamber conveying member 304 is positioned above the collection-chamber conveying member 305. The supply chamber 304*a* that is a space around the supply-chamber conveying member 304 in the developer case 301 and the collection chamber 305*a* that is a space around the collection-chamber conveying member 305 are adjacent to each other across the partition plate 306. As illustrated in FIGS. 4 and 5, the end of the front side FS of each of the supply-chamber conveying member 304 and the collection-chamber conveying member 305 is set slightly forward of the end of the front side FS of the developing roller 302. The above setting ensures the supply of the developer 320 from inside of the supply chamber 304*a* to the end of the front side FS of the developing roller 302. Further, the end of the rear side BS of each of the supply-chamber conveying member 304 and the collection-chamber conveying member 305 is set farther than the end of the rear side BS of the developing roller 302. This setting ensures a space for toner supply. The length of the developer regulator 303 in the longitudinal direction is set according to the length of the developing roller 302.

As illustrated in FIG. 3, the partition plate 306 that spatially divides the supply chamber 304*a* and the collection chamber 305*a* is supported inside the developer case 301 between the supply-chamber conveying member 304 and the collection-chamber conveying member 305. The communication ports 41 and 42 (see FIG. 6) are provided at both ends in the longitudinal direction of the partition plate 306. The conveying path of the developer 320 conveyed from the rear side BS to the front side FS in the longitudinal direction (indicated by the arrow D2 in FIG. 4) by the collection-chamber conveying member 305 is blocked by a side wall of the developer case 301 at an end the collection-chamber conveying member 305 in the conveying direction of the developer 320 and rises along the side wall. Due to this rise, the developer 320, which has reached the downstream end in the conveying direction in the collection chamber 305*a*, passes through the communication port 41 (as indicated by arrow D3 in FIG. 4) at the end of the front side FS in the longitudinal direction, of the communication ports 41 and 42 on both longitudinal ends of the partition plate 306 described above, and is delivered to the supply chamber 304*a*.

The developer 320 delivered to the supply chamber 304*a* is conveyed from the front side FS to the rear side BS in the longitudinal direction inside the supply chamber 304*a* by the supply-chamber conveying member 304 (arrow D4 of FIG. 4). Similarly to the case of the collection chamber 305*a*, the conveying path of the developer 320 conveyed from the front side FS to the rear side BS in the longitudinal direction by the supply-chamber conveying member 304 is blocked by the side wall of the developer case 301 at the end of supply-chamber conveying member 304 in the conveying direction of the developer 320. The developer 320, which has reached the downstream end in the conveying direction inside the supply chamber 304*a*, falls from the communication port 42 at the end of the rear side BS in the longitudinal direction, of the communication ports 41 and 42 on both longitudinal ends of the partition plate 306 described above, and is delivered to the collection chamber 305*a*. The developer 320 delivered to the collection chamber 305*a* is again conveyed to the front side FS by the collection-chamber conveying member 305 (as indicated by the arrow D2 of FIG. 4).

Further, in the developing device 3, the space between the supply chamber 304*a* and the collection chamber 305*a* is partitioned by the partition plate 306. Therefore, only the developer 320 in which toner and carrier are sufficiently stirred and mixed is supplied to the developing roller 302 by the supply-chamber conveying member 304. Further, the developer 320 having a decreased toner density immediately after developing is exclusively stirred and conveyed by the collection-chamber conveying member 305 and is not immediately supplied to the developing roller 302. Therefore, only the developer 320 that contains the toner having the target charge amount and has the target toner density is supplied to the developing roller 302 and is used for developing, and thus high image quality can be obtained.

The developing device 3 includes a toner supply inlet 309 near the end of the rear side BS in the longitudinal direction, and toner is supplied from outside through the toner supply inlet 309. In the developing device 3 of the present embodiment, the vicinity of the end of the rear side BS in the longitudinal direction is the vicinity of the downstream end in the conveying direction in the supply chamber 304*a* that supplies the developer 320 to the developing roller 302. For this reason, the toner supplied from the toner supply inlet 309 is not immediately used for developing, but is supplied to the collection chamber 305*a* through the communication port 42.

In the developing device 3 described above, the conveying path of the developer 320 conveyed from the rear side BS to the front side FS in the longitudinal direction by the collection-chamber conveying member 305 (arrow D2 in FIG. 4) is blocked by the side wall of the developer case 301 at the end of the collection-chamber conveying member 305 in the conveying direction of the developer 320, and the conveying path of the developer 320 conveyed from the front side FS to the rear side BS in the longitudinal direction by the supply-chamber conveying member 304 is blocked by the side wall of the developer case 301 at the end of the supply-chamber conveying member 304 in the conveying direction of the developer 320. In the present embodiment, instead of the conveying path being cut off by the side wall at the end in the conveying direction, the blade at the end in the conveying direction is wound in the opposite direction to a direction in which the blade to convey the developer to the end in the conveying direction are wound, to give the developer a reverse conveying force.

FIG. 1A is an enlarged view of the front side FS of the collection-chamber conveying member 305 in the developing device 3 of the present embodiment. Unlike FIGS. 4 and 6, the right side in FIG. 1A is the front side FS. Further, in FIGS. 3 to 6, as each of the collection-chamber conveying member 305 and the supply-chamber conveying member 304, the screw with the blade wound to the left is used to convey the developer in a predetermined conveying direction, but in FIG. 1A, a screw with the blade wound to the right is used. The blades are wound in the opposite directions.

In order to realize the flows of the developer 320 illustrated by the arrows D1 to D4 in FIG. 4, the direction of rotation is reversed. In FIG. 4, the direction of rotation of the collection-chamber conveying member 305, which is viewed from the front side FS on the left side in FIG. 4, is counterclockwise (CCW), whereas in the example of FIG. 1, the direction of rotation of the collection-chamber conveying member 305, which is viewed from the front side FS on the right side in FIG. 1, is clockwise (CW). Similarly, the supply-chamber conveying member 304 corresponding to the screw of FIG. 1A includes a screw with the right-handed blade, and the rotational direction is also in the reverse direction of FIG. 4.

In FIG. 1A, the double-starts and left-handed blades, which have the reverse directional blades for conveying the developer 320 in the reverse direction, are provided at the end of the front side FS of the collection-chamber conveying member 305. The two left-handed blades are referred to a first reverse blade 12*a* and a second reverse blade 12*b*. The collection-chamber conveying member 305 includes two blades wound so as to convey the developer in the forward direction. The two forward directional blades are referred to a first forward blade 11*a* and a second forward blade 11*b*. The first forward blade 11*a* has an end face perpendicular to a shaft portion 305*b* at a conveying surface end position A1. A start position B1 of the first reverse blade 12*a* is a position away from the conveying surface end position A1 of the first forward blade 11*a* in the axial direction, and the first reverse blade 12*a* also has an end face perpendicular to the shaft portion 305*b* at the start position B. In this way, since the conveying surface end position A1 of the first forward blade 11*a* and the start position B1 of the first reverse blade 12*a* are axially separated from each other and have a gap G1, a space is created between both blades.

Figure 1B:
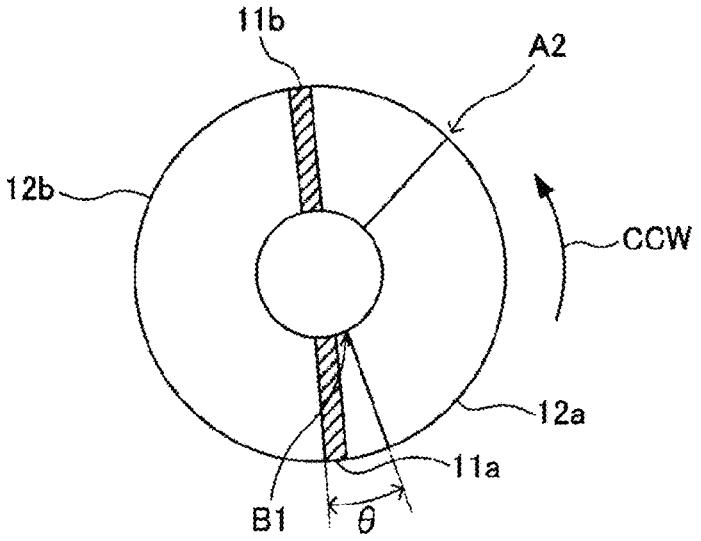

Moreover, as illustrated in FIG. 1B, which illustrates a cross-sectional view of the X-X cross section of FIG. 1A viewed from the direction of arrows (on the rear side BS, which is on the left side in FIG. 1A), the circumferential phase differs between the start position B1 of the first reverse blade 12*a* and the end position A1 of the conveying surface of the first forward blade 11*a*. Specifically, there is a phase difference corresponding to the angle θ between the end faces of both blades. This phase difference also creates a space between both blades. Even if the end position A1 of the conveying surface of the first forward blade 11*a* and the start position B1 of the first reverse blade 12*a* are in the same position in the axial direction or in a cross positional relationship, a space can be created by the phase difference in the circumferential direction. On the contrary, even if there is no phase difference or a crossing phase relationship, if there is a gap G1 in the axial direction between the conveying surface end position A1 of the first forward blade 11*a* and the start position B1 of the first reverse blade 12*a*, a space can be created between both blades.

In the example illustrated in FIG. 1B, the phase difference between the end faces of both blades at the start position B1 of the first reverse blade 12*a* and the conveying surface end position A1 of the first forward blade 11*a* is provided such that the phase at the start position B1 is shifted downstream in the rotation direction from the phase at the conveying surface end position A1. It is discriminated whether it is upstream or downstream in the rotation direction according to the positional relationship that forms an angle θ of 1800 or less.2.

Further, in the example illustrated in FIG. 1A, a portion of the second forward blade 11*b* is provided at a position that overlaps with the space between the two blades caused by the gap G1 and the like in the axial direction and is different from the first forward blade 11*a* and the first reverse blade 12*a* in the circumferential direction. The portion of the second forward blade 11*b* constitutes a conveying portion that conveys the developer 320 in the forward direction.

Further, in the example illustrated in FIG. 1A, the first reverse blade 12*a* and the second forward blade 11*b* are connected to each other. This configuration makes the blades stronger and easier to form. Then, a conveying surface end position A2 of the second forward blade 11*b* in this connection and the start position B2 of the second reverse blade 12*b* have a gap G2 in the axial direction, and the phases of the second forward blade 11*b* and the second reverse blade 12*b* in the circumferential direction are also different. Therefore, a space is also created between the second forward blade 11*b* and the second reverse blade 12*b*.

As described above, the space is formed with a phase difference in the circumferential direction between the first forward blade 11*a* and the first reverse blade 12*a*, and the space is formed with a phase difference between the second forward blade 11*b* and the second reverse blade 12*b* in the circumferential direction. For example, the following advantages over a conventional configuration are obtained. That is, if the conveying surface end position A1 of the first forward blade 11*a* and the start position B1 of the first reverse blade 12*a* are separated with a gap G1 in the axial direction but there is no phase difference (phase difference 0°) between the end faces of both blades at the start position B1 of the first reverse blade 12*a* and the conveying surface end position A1 of the first forward blade 11*a* (hereafter referred to as a comparative configuration), the following failure may occur. The comparative configuration has a structure in which a void area is simply provided between the forward winding blade and the reverse winding blade, and locally has an area that does not have a conveying force in the forward direction. In that area, developer stays completely in place, and the developer insufficiently charged is generated. If the low-charged developer in that area is raised by the blade and fed to the developing roller, there is a risk that uneven density due to the conveying blade pitch may occur in the image. When the blade in the reverse winding direction is used in the image forming area of the developing roller 302 for downsizing of the unit, uneven image density due to the conveying screw pitch is particularly likely to occur.

In contrast, if a space is formed with a phase difference between the first forward blade 11*a* and the first reverse blade 12*a* in the circumferential direction or a space is formed with a phase difference between the second forward blade 11*b* and the second reverse blade 12*b* in the circumferential direction, the flipping-up of the developer 320 by the reverse winding blade can be restrained. Specifically, since a space is provided between the blade in the forward winding direction and the blade in the reverse winding direction and the phase of the start position of the blade in the reverse winding direction is shifted from the end position of the blade in the forward winding direction, the flow of the developer 320 in the reverse winding direction and the flow of the developer 320 in the forward winding direction do not collide with each other, and the developer 320 does not stay locally in the entire conveying direction. As a result, the flipping-up of the developer 320 is restrained, and the uneven image density due to the conveying screw pitch can be prevented. In addition, the reverse winding blade restrains the conveying force of the developer 320 in the forward direction, which slows down the conveying speed of the developer 320 and allows the developer 320 to accumulate. Accordingly, the bulk of developer 320 is raised, thus allowing smooth delivery of the developer 320. In other words, while maintaining the function of raising the bulk of the developer 320 by the reverse winding blade, the flipping-up of the accumulated developer 320 generated between the forward winding blade and the reverse winding blade can be restrained.

In particular, the phase difference between the end faces of both blades is provided so that the phase of the start position B1 is shifted downstream of the phase of the conveying surface end position A1 in the rotational direction. Therefore, without being colliding with the developer 320 conveyed in the forward direction by the conveying surface of the first forward blade 11*a* and the developer 320 conveyed in the reverse direction by the conveying surface of the first reverse blade 12*a*, the developer 320 is not accumulated and jumped up by the rotation of the conveying member, and flows smoothly into the space section.

Further, since a portion of the second forward blade 11*b* is present at a position that overlaps with the space between the two blades caused by the gap G1 and the like in the axial direction and is different from the first forward blade 11*a* and the first reverse blade 12*a* in the circumferential direction and the portion constitutes the conveying portion that conveys the developer 320 in the forward direction, the developer 320 flowing into the space is conveyed by the second forward blade 11*b* as the other forward winding direction blade and can be prevent too much developer 320 from accumulating in the space. With such a configuration, the conveying speed of the developer 320 is slowed by the reverse winding blade, so that the bulk of the developer 320 at this position can be increased. Since no developer 320 accumulates, the developer 320 can be prevented from being flipped up in a direction other than the conveying direction due to the rotation of the screw.

More specific examples are as follows. The diameter of the shaft of the conveying screw is 6 mm, and the height of the blade is 4.5 mm for both the forward winding blade and the reverse winding blade. In other words, the outer diameter of the screw is 15 mm. The lead length of each of the first forward blade 11*a* and the second forward blade 11*b* is 30 mm (the pitch distance is 15 mm). The lead length of each of the reverse winding blade corresponds to 15 mm. By making the lead length of the reverse winding blade smaller than that of the forward winding blade, the conveying force in the reverse direction becomes weaker than the conveying force in the forward direction, thus allowing smooth conveyance. A space is provided at the connecting portion of the forward winding blade and the reverse winding blade. The width of the space is set to 5 mm in the present embodiment, but is not limited to 5 mm. The start position B1 of the reverse winding blade is shifted by a phase of 15° to the downstream side of the rotation direction from the conveying surface end position A1 of the first forward blade 11*a*. This configuration makes it easier for the flow of the developer 320 conveyed by the conveying surface to flow into the space between the forward and reverse blades without being obstructed by the first reverse blade 12*a*. The accumulation of the developer 320 is less likely to occur around the space, and the jumping up of the developer 320 due to the rotation of the screw can be suppressed. Further, the developer 320 in the space is conveyed by another forward winding blade arranged in the same circumferential direction in this space. Such a configuration can restrain the local accumulation and further restrain the flipping-up of the developer 320. The conveying speed of the developer 320 is also slowed by the reverse winding blade, thus allowing the bulk of developer 320 at this position to be increased. In this configuration, it is preferable that the forward winding blade has a double-start structure as in the present embodiment, but this is not limited to this configuration. Further, when the conveying speed of the developer 320 is slowed down and the effect of increasing the bulk of the developer 320 is increased, the 20 second reverse blade 12*b* may be added and the double-start structure may be used as in the present embodiment. In this case as well, by shifting the phase at the start position B2 of the reverse winding blade from the conveying surface end position A2 of the forward direction blade the same jumping up suppression effect can be obtained. The forward winding blade and the reverse winding blade may have a structure of triple-start or more.

Although the collection-chamber conveying member 305 has been described above, the supply-chamber conveying member 304 can also be configured similarly. The developer 320 conveyed in the supply chamber 304*a* and conveyed to the rear end of the developing roller 302 without being supplied to the developing roller 302 is falls freely as illustrated in arrow D1 in FIG. 4 and conveyed to the collection chamber 305*a*. The developer 320 is apt to run short in front of the communication port 42 for free fall, and a configuration for storing the developer 320 is required. In order to store the developer 320 in this way, the configuration described for the collection-chamber conveying member 305 can be adopted.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A developing device, comprising:

a developer bearer; and a stirring conveyor configured to convey and stir a developer to be supplied to the developer bearer, the stirring conveyor including:

a first conveying chamber including a conveying member; and a second conveying chamber configured to receive the developer from an end of the first conveying chamber, and the conveying member including:

a first forward winding blade and a second forward winding blade, both forward winding blades configured to convey the developer in a first direction toward the end of the first conveying chamber; and a first reverse winding blade and a second reverse winding blade, both of the reverse winding blades configured to convey the developer in a second direction opposite the first direction; and a shaft portion on which the first forward winding blade, the second forward winding blade, the first reverse winding blade, and the second reverse winding blade are mounted with a first space between the first forward winding blade and the first reverse winding blade, and a second space between second forward winding blade and the second reverse blade, and wherein a circumferential phase of the conveying member at a start position of the first reverse winding blade is different from a circumferential phase of the conveying member at an end position of the first forward winding blade, wherein the conveying member is disposed in the first conveying chamber so that the first space is opposite a portion at which the second conveying chamber receives the developer from the end of the first conveying chamber.

2. The developing device according to claim 1, wherein the circumferential phase of the conveying member at the start position of the first reverse winding blade is shifted downstream in a direction of rotation of the conveying member from the circumferential phase of the conveying member at the end position.

3. The developing device according to claim 1, wherein a pitch of the first reverse winding blade is smaller than a pitch of the first forward winding blade.

4. An image forming apparatus comprising the developing device according to claim 1.

5. The developing device according to claim 1, wherein a circumferential phase of the conveying member at a start position of the second reverse winding blade is different from a circumferential phase of the conveying member at an end position of the second forward winding blade.

* * * * *